US008579530B2

(12) United States Patent
Krauss

(10) Patent No.: US 8,579,530 B2
(45) Date of Patent: Nov. 12, 2013

(54) AEROSOL SYSTEM

(75) Inventor: Sebastian Krauss, Darmstadt (DE)

(73) Assignee: KAO Germany GmbH, Darmstadt (DE)

( * ) Notice: Subject to any disclaimer, the term of this patent is extended or adjusted under 35 U.S.C. 154(b) by 769 days.

(21) Appl. No.: 12/142,350

(22) Filed: Jun. 19, 2008

(65) Prior Publication Data

US 2009/0020560 A1 Jan. 22, 2009

(30) Foreign Application Priority Data

Jun. 20, 2007 (EP) ..... 07012053

(51) Int. Cl.
*A46B 5/02* (2006.01)

(52) U.S. Cl.
USPC ..... 401/190; 401/187

(58) Field of Classification Search
USPC ..... 401/190, 44–47, 187, 188 R; 222/402.17, 145.4, 145.1, 402.13, 222/402.21, 144.5; 239/304, 305, 307
See application file for complete search history.

(56) References Cited

U.S. PATENT DOCUMENTS 1,082,159 A * 12/1913 Kelley ..... 239/307
3,084,871 A * 4/1963 Puglis ..... 239/305
3,198,394 A * 8/1965 Lefer ..... 222/144.5
3,211,343 A * 10/1965 Silver ..... 222/144.5
3,297,209 A * 1/1967 Pungitore ..... 222/144.5
3,366,279 A * 1/1968 Parker, Jr. et al. ..... 222/144.5
4,006,841 A 2/1977 Alticosalian
4,595,127 A * 6/1986 Stoody ..... 222/144.5
5,152,431 A * 10/1992 Gardner et al. ..... 222/144.5
5,385,270 A * 1/1995 Cataneo et al. ..... 222/134
5,509,742 A * 4/1996 Balzarini ..... 401/17
5,568,883 A * 10/1996 Cataneo et al. ..... 222/136
5,634,571 A * 6/1997 Cataneo et al. ..... 222/80
6,877,924 B1 * 4/2005 Mears et al. ..... 401/190
7,090,097 B1 * 8/2006 Kazarian et al. ..... 222/144.5
7,331,488 B2 * 2/2008 Naslund et al. ..... 222/144
7,350,524 B2 * 4/2008 Kimura et al. ..... 132/114

FOREIGN PATENT DOCUMENTS

DE 9413316 U1 11/1994
DE 9413316 U1 * 11/1994
GB 2116261 A 9/1983

* cited by examiner

*Primary Examiner* — David J. Walczak
*Assistant Examiner* — Jennifer C Chiang
(74) *Attorney, Agent, or Firm* — Norris McLaughlin & Marcus, P.A.

(57) ABSTRACT

Aerosol System comprising at least two aerosol containers for separately keeping different substances, wherein each aerosol container has a valve portion; and a head portion containing a channel system and an exhaust opening, where the channel system provides communication between at least one of the valve portions and the exhaust opening; characterized in that the head portion or parts of the head portion are movable in respect to at least one aerosol container, such that the channel system can take different configurations.

17 Claims, 3 Drawing Sheets

AEROSOL SYSTEM

TECHNICAL FIELD

The present invention relates to an aerosol system of two or more aerosol containers including a cleaning function.

BACKGROUND ART

Aerosol systems, comprising two or more aerosol containers, are well known and designed to allow two or more fluid components to be mixed when operating the system. These systems are, for example, known as two-component systems which are used for colours or hair tinting lotions or other fluids which need to be separated, until ejection, for avoiding an undesired mixture or a precipitated reaction of the components.

For this purpose, there is known a two-component system including two containers which are interleaved, wherein the outer container contains a valve portion operating the valve of the second container and at the same time ejecting the mixed fluid. These container systems have the disadvantage that a design of reusing the inner container is hard to accomplish.

DE 23 25 512 discloses an aerosol system containing three aerosol containers of which two aerosol containers include product fluids which are supposed to be mixed when operating the system, and a third container contains a cleaning fluid for cleaning parts of the head portion. The system according to the aforementioned document contains two actuating buttons, one for mixing/ejecting the product fluids and the other for cleaning the channel system being part of the head portion. Such a design does not exclude accidentally operating the wrong and/or both actuators which may have undesired consequences, depending on the field of application. Further, additional components in the form of a second actuator could increase costs and weight.

In such known applications for aerosol systems, it is desirable to separately keep different substances in different containers, either for later mixing during usage or for individually ejecting from a desired container. A head portion is designed to guide the fluids to an exhaust opening. Depending on the field of application, such a head portion can carry attachments such as a brush in the case of hair mascara.

In such applications, it is hardly avoidable that product fluids adhere to parts of the head portion when being ejected and thereby contaminating the channel system and other components. This might reduce the performance of the aerosol system as well as undesirably pollute other product fluids having the same flow path. It might therefore desirable or necessary to provide an aerosol container containing a cleaning fluid flowing through the channel system and the exhaust opening and thereby cleaning those parts. The cleaning fluid could simply be water, a solvent or something else. Instead of a liquid, the container containing the cleaning fluid could also contain a cleaning gas, where a cleaning is performed by a pressurized propellant.

When using aerosol systems with two or more aerosol containers, particular care needs to be taken in order to actuate the desired container and to avoid accidental ejection of unwanted fluids.

DISCLOSURE OF THE INVENTION

It is, therefore, an object of the present invention to provide an aerosol system containing two or more aerosol containers which is easy and comfortable to use and provides at the same time a high degree of safety regarding ejection of the desired fluid.

This object is achieved by an aerosol system according to claim 1. Preferred embodiments of the invention are defined in the dependent claims.

An aerosol system according to the present invention comprises at least two aerosol containers for separately keeping different substances, wherein each aerosol container has a valve portion; and a head portion containing a channel system and an exhaust opening where the channel system provides communication between at least one of the valve portions and the exhaust openings, characterized in that the head portion or parts of the head portion are movable in respect to at least one aerosol container, such that the channel system can take different configurations.

Instead of having different actuators for different product fluids and the cleaning fluid, the present invention preferably provides one actuator and thereby prevents the user from accidentally operating the wrong actuator or more than one actuator at one time. Which one of the aerosol containers is actually operated when pushing the actuator is determined by the structural configuration of at least parts of the head portion. In cosmetic applications such a safety mechanism is particularly desirable. As explained more precisely in the embodiments of the present application, the channel system of the head portion provides communication between at least one valve portion and an exhaust opening of the head portion. If the configuration is such that a flow path between the valve portion of the container providing the cleaning fluid and the exhaust opening is established, pushing the actuator operates the valve portion of the container providing the cleaning fluid and causes the cleaning fluid to pass the channel system and to be ejected by the exhaust opening, possibly flowing through additional attachments of the head portion.

After cleaning by operating the actuator, the channel system can be configured such that the exhaust opening communicates with at least one container including a product fluid. Similar as above, operating an actuator causes a product fluid to be ejected. In this way, the aerosol system can be switched between one or more working modes and a cleaning mode. The different configurations are achieved by moving the head portion which results in a rearrangement of the channel system. In this respect it is also conceivable to provide an additional head configuration state where none of the aerosol containers is activated when operating the actuator. Such an additional state provides safety in situations where an accidental operation of the system should be avoided, for instance during transportation.

Preferably, the aerosol system according to the present invention contains exactly one button for operating at least one aerosol container.

According to a preferred embodiment, the present invention provides exactly one button for operating each aerosol container individually or two or more aerosol containers collectively. Which aerosol container or which aerosol containers are operated is determined by the channel configuration which has a one-to-one correspondence to the actual head position.

Preferably, an aerosol system according to the present invention is characterized in that at most one valve portion communicates with the exhaust opening, in each channel configuration.

In a preferred embodiment implementing for instance a cleaning operation as described above, it is desired to have a strict one-to-one communication between exactly one valve portion and the exhaust opening.

In a preferred embodiment of the present invention, a mixture between a cleaning fluid and a product fluid, such as mascara, is not desired and, therefore, the head portion together with a channel system is arranged such that at most one valve portion communicates with the exhaust opening. In the case of a cosmetic application containing a single product fluid and a cleaning fluid, an aerosol system according to the present invention preferably provides a head portion that can be switched between two channel configurations, whereas the system contains two aerosol containers.

Preferably, an aerosol system according to the present invention provides a channel system that can take different configurations by shifting, rotating, twisting or tilting the head.

In order to provide an aerosol system that is well-priced and easy to handle, a channel configuration change is preferably achieved by manually moving parts of the head portion in a mechanical fashion. Although shifting, rotating, twisting and tilting belong to the most common and convenient ways to be implemented, other realisations are imaginable.

Preferably, an aerosol system according to the present invention provides a head portion that is removable or can be opened.

It might be desirable or necessary to clean parts of the aerosol system others than those being covered by a cleaning fluid. Therefore, a head portion that is removable or can be opened is preferably provided. Such a head, for instance, could be tilted by means of a hinge and could be secured by means of a clip-in or snap-in mechanism. Therefore the mechanism of changing the channel configuration is hidden, such that the head portion needs to be opened before changing the channel configuration. This helps to prevent accidental changing the channel configuration and thereby changing the operating mode.

Preferably, an aerosol system according to the present invention has a head portion that includes a cosmetic head, such as a mascara head, and has one aerosol container containing a cosmetic fluid, such as mascara, and another aerosol container containing a cleaning fluid.

DETAILED DESCRIPTION OF PREFERRED EMBODIMENTS

Figure 1B:
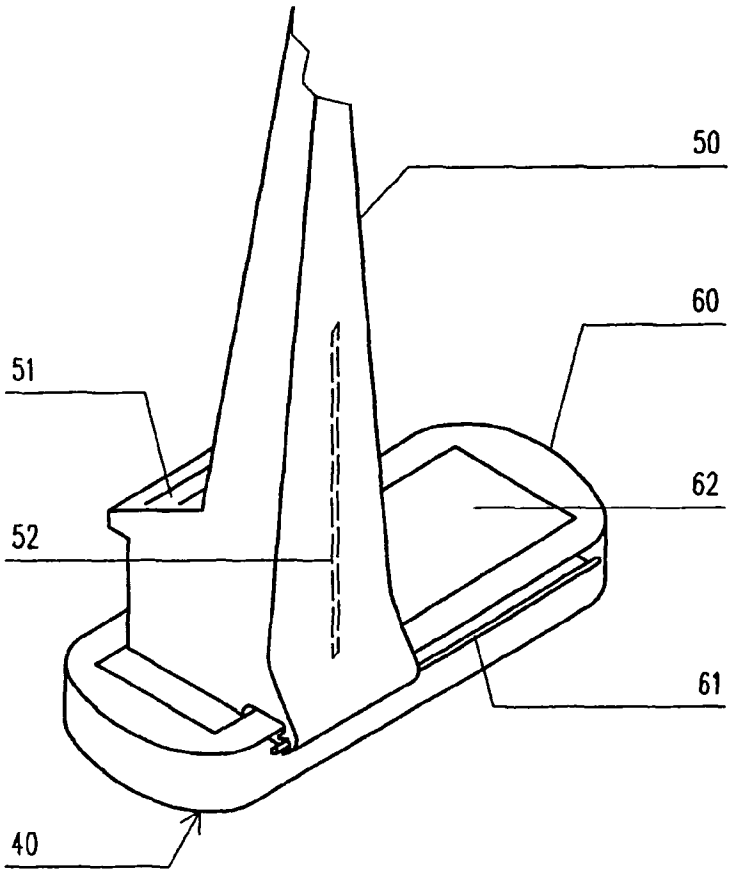
FIG. 1*b* is a perspective view of a slidable mascara head according to the first embodiment of the present invention.
Figure 1A:
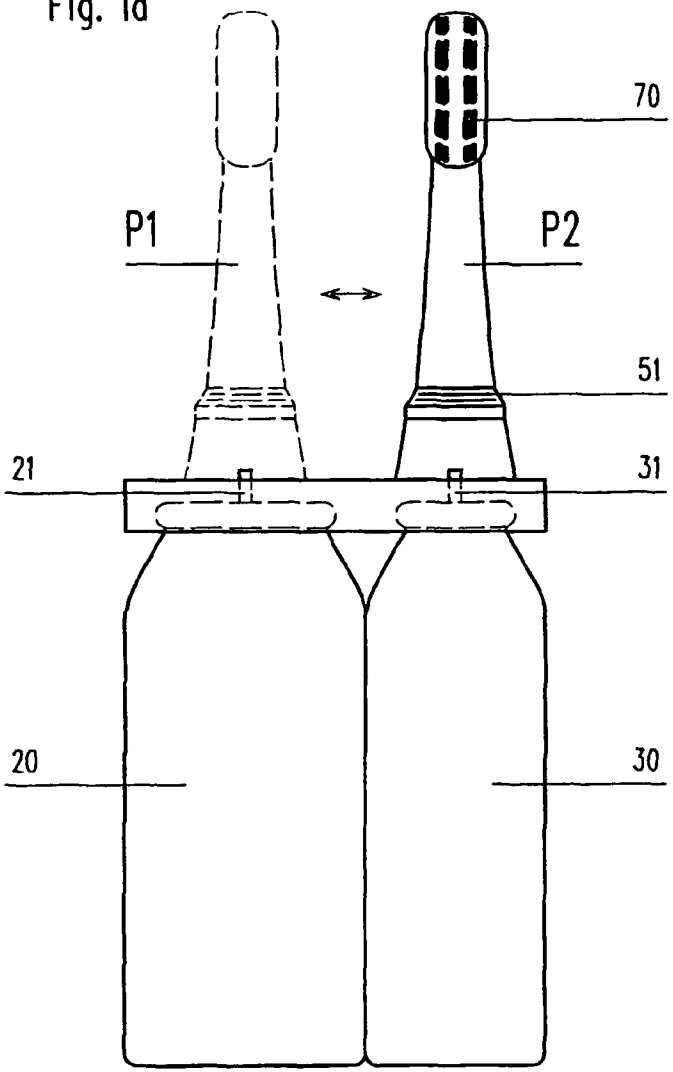
FIG. 1*a* is a side view of a double aerosol system including a slidable mascara head according to a first embodiment of the present invention.

FIG. 1*a* shows a double aerosol system 10 including a first aerosol container 20 and a second aerosol container 30. FIG. 1*b* is a perspective partial view of the head portion 40. The aerosol container 20 contains a product fluid such as mascara, and the container 30 contains a cleaning fluid which could simply be water, a solvent or some other liquid. Instead of a liquid, the second container 30 could also contain a cleaning gas, where cleaning is performed by a pressurized propellant. Each of the containers 20, 30 have valve portions 21, 31, respectively, for ejecting the fluid when operated. The valve portions 21, 31 are formed in a conventional way having a valve which is opened by pushing down.

Figure 2B:
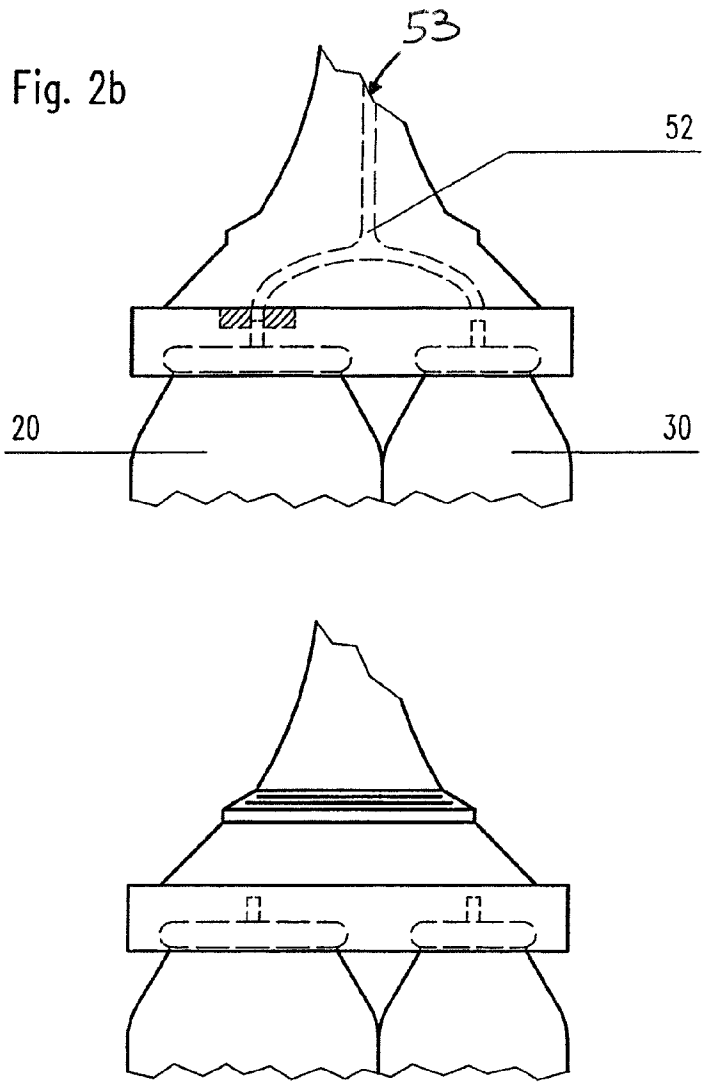
FIG. 2*b* is a side view of a double aerosol system, indicating the channel system therein, according to a second embodiment of the present invention.
Figure 3B:
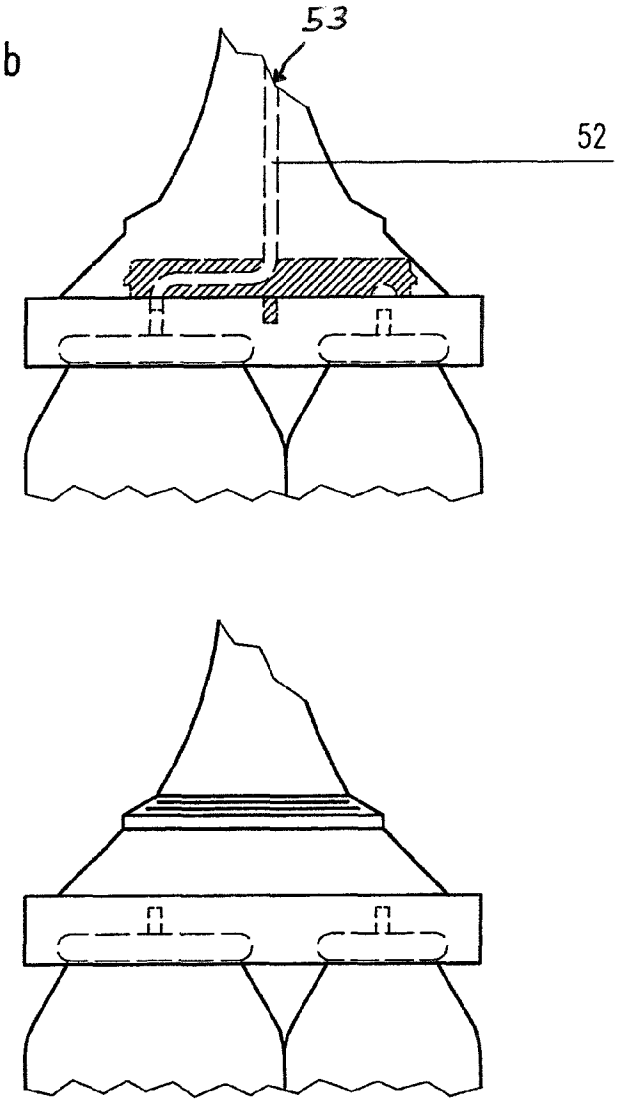
FIG. 3*b* is a side view of a double aerosol system, indicating the channel system therein, according to a third embodiment of the present invention.

The double aerosol system 10 further includes a head portion 40 which has an upper head part 50 being slidably mounted on a lower head part 60 by means of a sliding bar 61, for guiding the upper part 50, and an attachment 70, which is a brush in the present embodiment. The lower head part 60 is fixedly attached to the aerosol containers 20, 30. The upper head part has an actuator 51 for actuating one of the two aerosol containers 20, 30. A channel system 52 (as shown in FIGS. 1*b*, 2*b* and 3*b*) disposed within the upper head part 50 provides a passage between the valve portions 21 or 31 and an exhaust opening 53 (as shown in FIGS. 2*b* and 3*b*) of the head portion 40. For this purpose the lower head part 60 has an extended opening 62 to allow communication between the opening of a valve portion 21 or 31 and the lower opening of the channel system 52. The upper head part 50 may contain attachments 70 or parts such as tools or brushes.

As indicated in FIG. 1*a* the upper head part 50 can be slidably moved between two end positions P1 and P2 by means of the sliding bar 61, whereby each end position corresponds to an operating mode, i.e. either the working mode or the cleaning mode of the aerosol system 10. In FIG. 1*a* the head portion 40 is located in position P2, i.e. over container 30 including the cleaning fluid, such that a flow path between the valve portion 31 and the exhaust opening 53 is established. Pushing down the actuator 51 opens the valve portion 31 and causes the pressurized cleaning fluid to be ejected from the exhaust opening 53 and thereby cleaning its flow path, in particular cleaning the channel, the exhaust opening and parts of the attachment 70. By manually sliding the upper head part to position P1, as indicated by dashed lines in FIG. 1*a*, the aerosol system 10 is switched from the cleaning mode into the working mode and communication between container 20 and the exhaust opening via the channel system 52 is provided.

It is useful to provide locking means for detachable fixing the upper part 50 in the predetermined positions P1 or P2, in order to provide a guided and secured positioning of the upper part 50 in one of the two states.

Figure 2A:
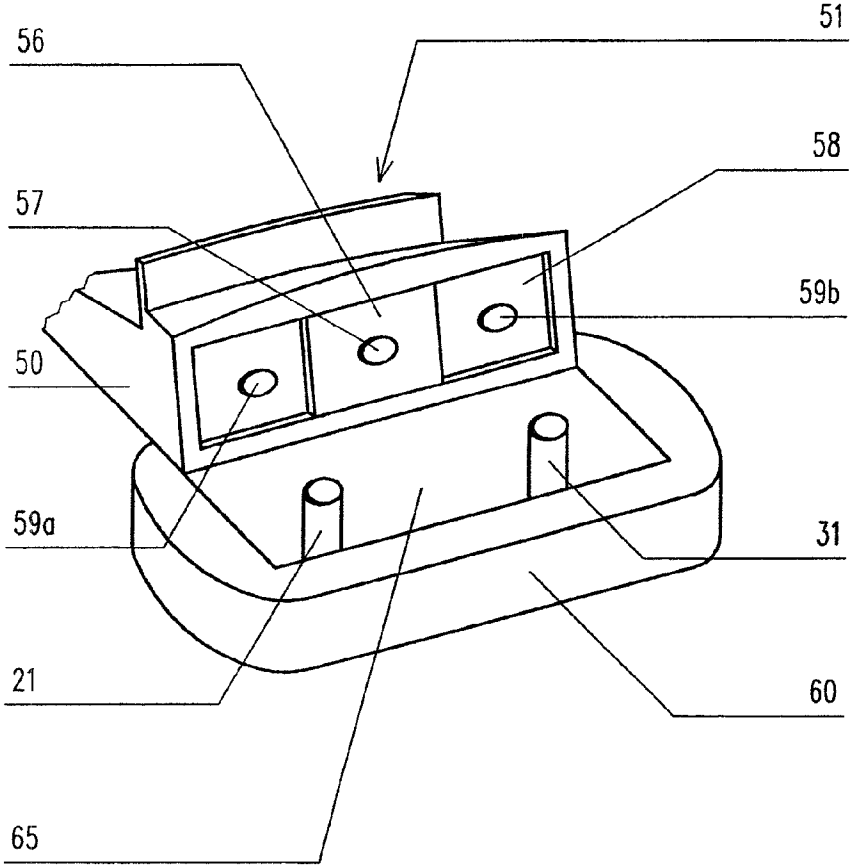
FIG. 2*a* is a perspective view of an opened mascara head including a slider according to a second embodiment of the present invention.

A second embodiment according to FIGS. 2*a* and 2*b* is described below. The head portion 40 in FIG. 2*a* contains a lower part 60 and an upper part 50. Similar to the previous embodiment, the upper part 50 has an actuator 51 serving for both aerosol containers 20, 30. The upper part 50 is tiltable connected to the lower part 60 which is fixedly attached to the aerosol containers 20, 30. The articulation means 65 allows for opening the head portion 40 by tilting the upper part 50 with respect to the lower part 60. It is advisable to provide a means for securing the head portion 40 in a closed position (not shown in the Figures).

The upper part 50 of the head portion 40 has a slider 56 disposed within an extended rectangular upper opening 58 allowing the slider 56 to be moved along a predetermined path. The slider 56 contains a hole 57 which is part of a flow path between a valve portion 21, 31 and the exhaust opening 53.

In contrast to the previous embodiment the operation mode of the head portion 40 is changed by moving the slider 56 instead of the entire upper part 50. Hence, the mechanism for a configuration change is hidden which prevents the aerosol system 10 from accidentally changed to a different operation mode.

In this embodiment, the upper part 50 of the head portion 40 includes two channel openings 59*a*, 59*b* which are the entrances of respective channels. Both channels are combined within the upper part 50 of the head portion 40 to form a single output channel ending at the exhaust opening 53, refer to FIG. 2*b*. Similar to the previous embodiment the slider 56 can be slidably moved between two end positions P1 and P2, whereby each end position corresponds to either the working mode or the cleaning mode of the aerosol system 10. In FIG. 2*b* the slider is located in position P1, i.e. over container 20 including the product fluid, such that a flow path between the valve portion 21 and the exhaust opening 53 is established. The channel system 52 is indicated in FIG. 2*b*. Pushing down the actuator 51 opens the valve portion 21 and causes the pressurized product fluid to be ejected from the exhaust opening 53. Since the slider 56 serves as a transmitter of the pushing-pressure, only the valve portion 21 is opened and the container 30 having the cleaning fluid is not activated. By manually sliding the slider 56 to position P2, the aerosol system 10 is switched from the working mode into the cleaning mode and communication between container 30 and the exhaust opening 53 via the channel is provided.

It is useful to provide locking means for detachable fixing the slider 56 in predetermined positions P1 or P2 in order to provide a guided and secured positioning of the slider 56 in one of the two states.

Which aerosol container is actually actuated depends on the position of the slider 56. For changing the head configuration, i.e. for sliding the slider 56, the head portion 40 must be opened according to FIG. 2*a*. For this purpose, a side of the lower part 60 of the head portion 40 and a side of the upper part 50 of the head portion 40 are articulately joined with each other in order to allow tilting the upper part 50 with respect to the lower part 60. Providing a head portion 40 that can be opened also allows for cleaning those parts, which are not covered by the cleaning fluid during cleaning operation. Further, the mechanism of changing the channel configuration after opening the head portion 40, helps to prevent accidentally changing the channel configuration and thereby changing the operating mode.

Figure 3A:
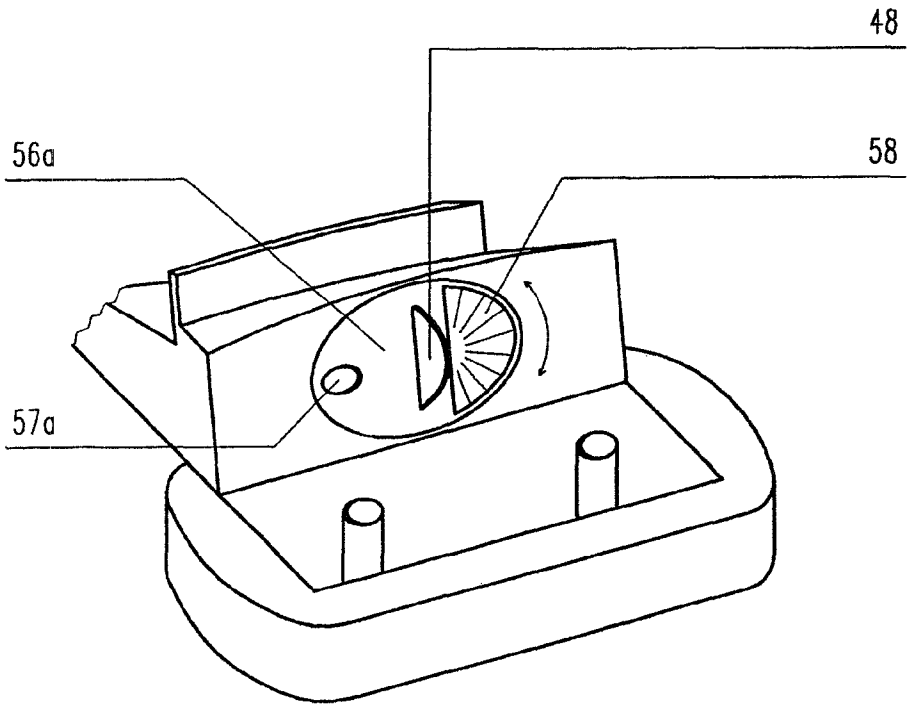
FIG. 3*a* is a perspective view of an opened mascara head including a twister according to a third embodiment of the present invention.

FIGS. 3*a* and 3*b* show a third embodiment of the present invention using a twister 56*a* instead of the slider 56 for changing the configuration of the aerosol system 10. Many features and elements are similar to those of the previous embodiment and carry the same reference signs.

The communication between a valve portion 21, 31 of one of the containers 20, 30 and the exhaust opening 53 is achieved via the twister 56*a*. The twister 56*a* contains a hole 57*a* and a cavity 58. Similar to the aforementioned slider 56, the hole 57*a* provides communication between the channel entrance of the upper part 50 of the head portion 40 and a valve portion 21, 31 of an aerosol container 20, 30.

Again, the upper part 50 of the head portion 40 includes two openings which are the entrances of respective channels. Both channels are combined within the upper part 50 of the head portion 40 to form a single output channel ending at an exhaust opening 53. The twister is rotatably mounted to the upper part 50 of the head portion 40 and can either be designed to rotate back and forth between two end positions P1 and P2 or continuously rotate. Also in this embodiment the twister 56*a* can take one of the two preferred states P1 or P2 whereby each end position corresponds to either the working mode or the cleaning mode of the aerosol system 10. In FIG. 2*b* the twister 56*a* is located in position P1, i.e. over container 20 including the product fluid, such that a flow path between the valve portion 21 and the exhaust opening 53 is established. The channel system 52 is indicated in FIG. 2*b*. Pushing down the actuator 51 opens the valve portion 21 and causes the pressurized product fluid to be ejected from the exhaust opening 53. Since the twister 56*a* serves as a transmitter of the pushing-pressure, only the valve portion 21 is opened and the container 30 having the cleaning fluid is not activated, since the cavity prevents the valve portion 31 from being pressed down. By manually rotating the twister to position P2, the aerosol system 10 is switched from the working mode to the cleaning mode and communication between container 30 and the exhaust opening 53 via the channel is provided.

It is useful to provide locking means for detachable fixing the twister 56*a* in predetermined positions P1 or P2 in order to provide a guided and secured positioning of the twister 56*a* in one of the two states.

Which aerosol container is actually actuated depends on the position of the twister 56*a*. For changing the head configuration, i.e. for twisting the twister 56*a*, the head portion 40 must be opened according to FIG. 2*a*. For this purpose, a side of the lower part 60 of the head portion 40 and a side of the upper part 50 of the head portion 40 are articulately joined with each other in order to allow tilting the upper part 50 with respect to the lower part 60. Providing a head portion 40 that can be opened also allows for cleaning those parts, which are not covered by the cleaning fluid during cleaning operation. Further, a mechanism 48 of changing the channel configuration after opening the head portion 40, helps to prevent accidentally changing the channel configuration and thereby changing the operating mode.

The invention claimed is:

1. An aerosol system comprising at least two aerosol containers for separately keeping different substances, whereas each aerosol container has a valve portion; and a head portion containing a channel system and an exhaust opening, wherein the channel system provides communication between valve openings of the valve portions of the at least two aerosol containers and the exhaust opening, wherein the head portion comprises a head opening extending over the valve portions of the at least two aerosol containers;

wherein the head portion or at least one part of the head portion is movable with respect to the aerosol containers, such that the channel system can take different configurations when the head portion or the at least one part of the head portion is located in a first position or a second position, wherein the head opening in the head portion is configured for communication between a channel opening of the channel system and the valve openings of the valve portions of the at least two aerosol containers, wherein one aerosol container contains mascara, and another aerosol container contains a cleaning fluid, and further wherein the head portion or the at least one part of the head portion is a slider adapted to slide to the first position or the second position.

2. The aerosol system according to claim 1, wherein the system contains exactly one button for operating at least one aerosol container.

3. The aerosol system according to claim 1, wherein at most one valve portion communicates with the exhaust opening, in each channel configuration.

4. The aerosol system according to claim 1, wherein the channel system can take different configurations by shifting, rotating, twisting or tilting the head portion or parts of the head portion.

5. The aerosol system according to claim 1, wherein the head portion can be operated to switch between two channel configurations.

6. The aerosol system according to claim 1, wherein the system contains two aerosol containers.

7. The aerosol system according to claim 1, wherein the head portion or parts of the head portion are removable or can be opened.

8. The aerosol system according to claim 1, wherein the head portion includes a cosmetic head.

9. An aerosol system comprising:

a first aerosol container having a first valve portion and containing a first substance;

a second aerosol container having a second valve portion and containing a second substance different than the first substance contained within the first aerosol container; and a head portion having a movable part, a fixed part and an exhaust opening, wherein the fixed part of the head portion is fixedly attached to the first and second aerosol containers, wherein the fixed part comprises a first opening extending above the first valve portion of the first aerosol container and the second valve portion of the second aerosol container, wherein the first opening in the fixed part is configured for communication between a second opening of the movable part and a first valve opening of the first valve portion or a second valve opening of the second valve portion, wherein the movable part is moveable to a first position or a second position, wherein the movable part of the head portion is a slider adapted to slide to the first position or the second position, wherein, in the first position, the movable part is located over the first aerosol container when the aerosol system is in use and provides a first flow path between the first valve opening of the first valve portion of the first aerosol container and the exhaust opening of the head portion, and further wherein, in the second position, the movable part is located over the second aerosol container when the aerosol system is in use and provides a second flow path between the second valve opening of the second value portion of the second aerosol container and the exhaust opening of the head portion.

10. The aerosol system according to claim 9, wherein the movable part of the head portion is an upper head part of the head portion and the fixed part is a lower head part of the head portion.

11. The aerosol system according to claim 10, wherein the upper head part of the head portion has an actuator for actuating the first aerosol container or second aerosol container.

12. The aerosol system according to claim 9, wherein the first substance of the first aerosol container is mascara, and the second substance of the second aerosol container is cleaning fluid.

13. An aerosol system comprising:

a first aerosol container having a first valve portion and containing a first substance;

a second aerosol container having a second valve portion and containing a second substance different than the first substance contained within the first aerosol container; and a head portion having a movable part, a fixed part and an exhaust opening, wherein the fixed part of the head portion is fixedly attached to the first and second aerosol containers, wherein the fixed part comprises a first opening extending above the first valve portion of the first aerosol container and the second valve portion of the second aerosol container, wherein the first opening in the fixed part is configured for communication between a second opening of the movable part and a first valve opening of the first valve portion or a second valve opening of the second valve portion, wherein, during use of the aerosol system, the movable part is horizontally moveable to a first position or a second position, wherein, in the first position, the movable part provides a first flow path between the first valve opening of the first valve portion of the first aerosol container and the exhaust opening of the head portion, and further wherein, in the second position, the movable part provides a second flow path between the second valve opening of the second value portion of the second aerosol container and the exhaust opening of the head portion.

14. The aerosol system according to claim 13, wherein the movable part of the head portion is an upper head part of the head portion and the fixed part is a lower head part of the head portion.

15. The aerosol system according to claim 14, wherein the upper head part of the head portion has an actuator for actuating the first aerosol container or second aerosol container.

16. The aerosol system according to claim 13, wherein the movable part of the head portion is a slider adapted to slide to the first position or the second position.

17. The aerosol system according to claim 13, wherein the first substance of the first aerosol container is mascara, and the second substance of the second aerosol container is cleaning fluid.

* * * * *